US012590752B2

(12) United States Patent
Lessa et al.

(10) Patent No.: US 12,590,752 B2
(45) Date of Patent: Mar. 31, 2026

(54) LADDER ASSEMBLY

(71) Applicant: Whirlpool Corporation, Benton Harbor, MI (US)

(72) Inventors: Marcel Bögger Lessa, Joinville (BR); Dayabhushan Shankarrao Thorat, Pune (IN); Selina Haque, Berkley, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 204 days.

(21) Appl. No.: 18/488,650

(22) Filed: Oct. 17, 2023

(65) Prior Publication Data

US 2025/0123050 A1 Apr. 17, 2025

(51) Int. Cl.
*F25D 23/02* (2006.01)
*F25D 23/04* (2006.01)

(52) U.S. Cl.
CPC ..... *F25D 23/028* (2013.01); *F25D 23/04* (2013.01)

(58) Field of Classification Search
CPC ..... F25D 11/00; F25D 25/02; F25D 23/067; A47B 96/1408; A47B 57/34; A47B 57/10
See application file for complete search history.

(56) References Cited

U.S. PATENT DOCUMENTS

| | | | | |
|---|---|---|---|---|
| 9,261,305 | B2 | 2/2016 | Tunzi | |
| 9,879,900 | B1 | 1/2018 | Ammerman et al. | |
| 9,970,701 | B2 | 5/2018 | Cho et al. | |
| 10,610,016 | B2 | 4/2020 | Nilsson et al. | |
| 11,759,010 | B2 * | 9/2023 | Drew | A47B 96/1458 211/187 |
| 2004/0104323 | A1 | 6/2004 | Hubert et al. | |
| 2014/0252939 | A1 | 9/2014 | Tunzi | |
| 2016/0245324 | A1 | 8/2016 | Kilgore et al. | |
| 2021/0063079 | A1 | 3/2021 | Yeom | |

FOREIGN PATENT DOCUMENTS

| | | | |
|---|---|---|---|
| DE | 102010039533 | A1 | 1/2012 |
| KR | 2020190000828 | U | 4/2019 |
| WO | 2022037542 | A1 | 2/2022 |

OTHER PUBLICATIONS

European Patent Office, European Search Report, Feb. 17, 2025 (9 pages), the Hague.

* cited by examiner

*Primary Examiner* — Ana M Vazquez
(74) *Attorney, Agent, or Firm* — Price Heneveld LLP

(57) ABSTRACT

A ladder assembly for a door of a refrigeration unit includes a support ladder that includes a retention hook and defines a plurality of mounting apertures distributed along a length of the support ladder and a plurality of slots, a plurality of resilient snaps respectively received within the plurality of slots, and a ladder cover that defines a plurality of apertures. The support ladder is mounted to said door of said refrigeration unit. The ladder cover has first and second engagement features and is operable between disengaged and engaged conditions. In the disengaged condition, the second engagement feature is disengaged from the plurality of resilient snaps. In the engaged condition, the first engagement feature is engaged with the retention hook, the second engagement feature is engaged with the plurality of resilient snaps, and the plurality of apertures are respectively aligned with the plurality of mounting apertures.

19 Claims, 6 Drawing Sheets

LADDER ASSEMBLY

BACKGROUND OF THE DISCLOSURE

The present disclosure generally relates to a ladder assembly for a refrigeration unit. More specifically, the present disclosure relates to a ladder assembly for a refrigeration unit that includes a ladder cover.

SUMMARY OF THE DISCLOSURE

According to one aspect of the present disclosure, a ladder assembly for a door of a refrigeration unit includes a support ladder that includes a retention hook and defines a plurality of mounting apertures distributed along a length of the support ladder and a plurality of slots. The support ladder is mounted to said door of said refrigeration unit. The ladder assembly also includes a plurality of resilient snaps respectively received within the plurality of slots defined by the support ladder. The ladder assembly further includes a ladder cover that defines a plurality of apertures. The ladder cover has a first engagement feature and a second engagement feature and is operable between a disengaged condition and an engaged condition. In the disengaged condition, the second engagement feature is disengaged from the plurality of resilient snaps. In the engaged condition, the first engagement feature is engaged with the retention hook, the second engagement feature is engaged with the plurality of resilient snaps, and the plurality of apertures are respectively aligned with the plurality of mounting apertures.

According to another aspect of the present disclosure, a ladder assembly for a refrigeration unit includes a support ladder that includes a retention hook and defines a plurality of mounting apertures distributed along a length of the support ladder and a slot, a resilient snap received within the slot, and a ladder cover that includes a first engagement feature that is engaged with the retention hook and a second engagement feature that is engaged with the resilient snap to engage the ladder cover with the support ladder.

According to yet another aspect of the present disclosure, a ladder assembly for mounting a structure thereon includes a support ladder that defines a plurality of mounting apertures distributed along a length of the support ladder and a slot, a resilient snap received within the slot, and a ladder cover that includes an engagement feature that is engaged with the resilient snap in an engaged condition of the ladder cover to engage the ladder cover with the support ladder.

These and other features, advantages, and objects of the present disclosure will be further understood and appreciated by those skilled in the art by reference to the following specification, claims, and appended drawings.

Figure 1:
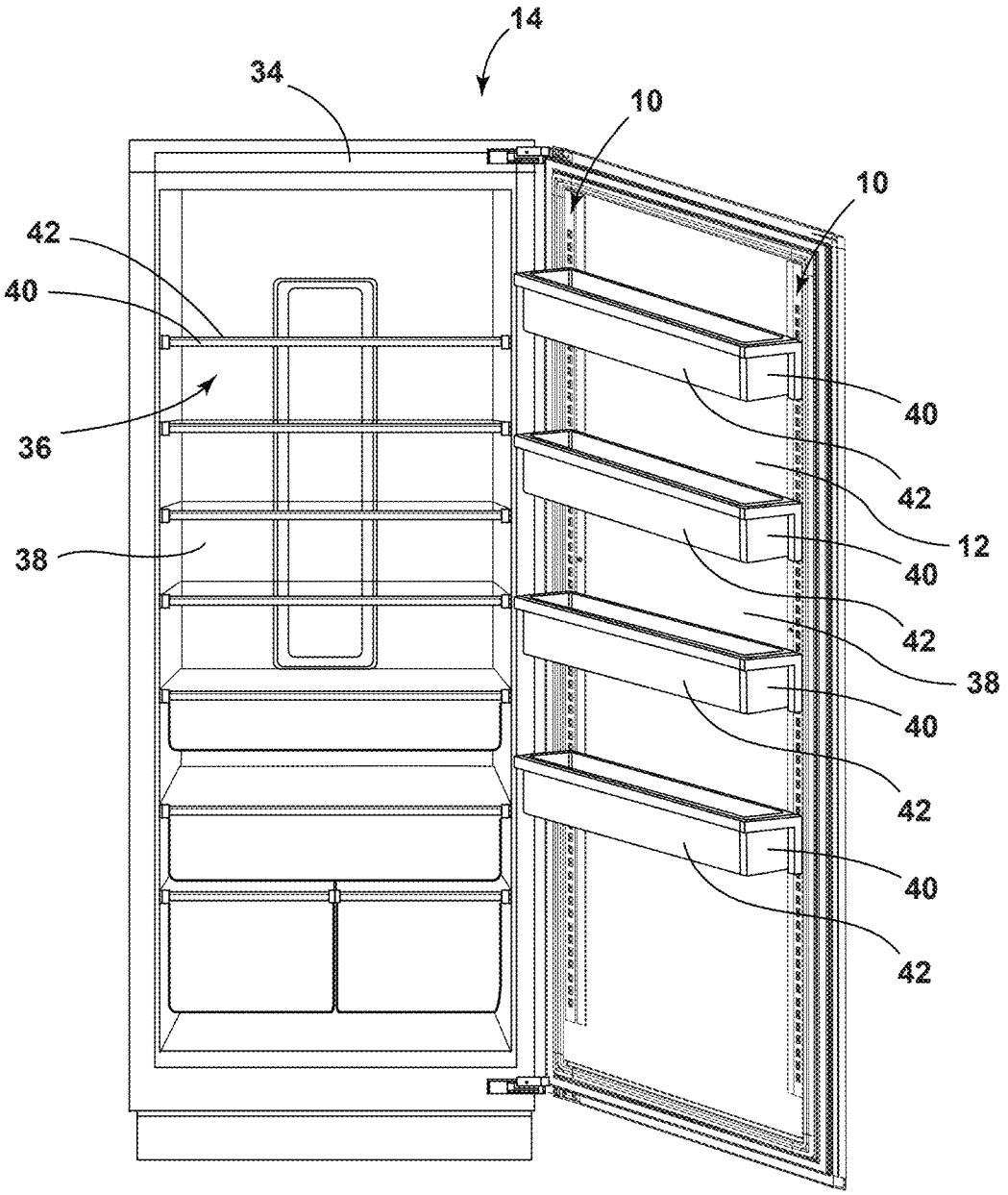
FIG. 1 is a front elevational view of a refrigeration unit that includes a cabinet, a door in an open position, and a ladder assembly secured to an inner liner of the door.

The components in the figures are not necessarily to scale, emphasis instead being placed upon illustrating the principles described herein.

DETAILED DESCRIPTION

The present illustrated embodiments reside primarily in combinations of apparatus components related to a ladder assembly for a refrigeration unit. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

The terms "including," "comprises," "comprising," or any other variation thereof, are intended to cover a non-exclusive inclusion, such that an article or apparatus that comprises a list of elements does not include only those elements but may include other elements not expressly listed or inherent to such article or apparatus. An element preceded by "comprises a . . . " does not, without more constraints, preclude the existence of additional identical elements in the article or apparatus that comprises the element.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

In this document, relational terms, such as "first" and "second," "top and bottom," and the like, are used solely to distinguish one entity or action from another entity or action, without necessarily requiring or implying any actual such relationship or order between such entities or actions.

For purposes of this disclosure, the term "coupled" (in all of its forms: couple, coupling, coupled, etc.) generally means the joining of two components (electrical or mechanical) directly or indirectly to one another. Such joining may be stationary or movable in nature. Such joining may be achieved with the two components (electrical or mechanical) and/or any additional intermediate members. Such joining may include members being integrally formed as a single unitary body with one another (i.e., integrally coupled) or may refer to joining of two components. Such joining may be permanent in nature, or may be removable or releasable in nature, unless otherwise stated.

The terms "substantial," "substantially," and variations thereof as used herein are intended to note that a described feature is equal or approximately equal to a value or description. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring now to FIGS. 1-6, a ladder assembly 10 for a door 12 of a refrigeration unit 14 includes a support ladder 16. The support ladder 16 includes a retention hook 18 and defines a plurality of mounting apertures 20 that are distributed along a length of the support ladder 16. The support ladder 16 also defines a plurality of slots 22. The support ladder 16 is mounted to the door 12 of the refrigeration unit 14. A plurality of resilient snaps 24 are respectively received within the plurality of slots 22 defined by the support ladder 16. A ladder cover 26 defines a plurality of apertures 28. The ladder cover 26 includes a first engagement feature 30 and a second engagement feature 32. The ladder cover 26 is operable between a disengaged condition and an engaged condition. In the disengaged condition, the second engagement feature 32 is disengaged from the plurality of resilient snaps 24. In the engaged condition, the first engagement feature 30 is engaged with the retention hook 18, the second engagement feature 32 is engaged with the plurality of resilient snaps 24, and the plurality of apertures 28 are respectively aligned with the plurality of mounting apertures 20.

Referring now to FIG. 1, the refrigeration unit 14 includes a cabinet 34. The cabinet 34 defines a storage compartment 36. In various implementations, the cabinet 34 can define a plurality of storage compartments 36, such as a refrigeration compartment and a freezer compartment. The refrigeration unit 14 includes a door 12 that is coupled to the cabinet 34. The door 12 is operable between an open position, as illustrated in FIG. 1, in which access to the storage compartment 36 defined by the cabinet 34 is provided, and a closed position, wherein the door 12 covers the storage compartment 36. The refrigeration unit 14 can include an inner liner 38. In various implementations, the refrigeration unit 14 can include a plurality of inner liners 38. For example, the cabinet 34 may include an inner liner 38 that defines the storage compartment 36, and the door 12 can include an inner liner 38. The inner liner 38 of the door 12 may be in communication with the storage compartment 36 defined by the inner liner 38 of the cabinet 34 in the closed position of the door 12, in various implementations.

The refrigeration unit 14 includes the ladder assembly 10. The ladder assembly 10 can be mounted to the door 12 and/or the cabinet 34 of the refrigeration unit 14, in various implementations. For example, the ladder assembly 10 may be secured to the inner liner 38 of the door 12 and/or the inner liner 38 of the cabinet 34 of the refrigeration unit 14. In the embodiment illustrated in FIG. 1, the ladder assembly 10 is secured to the inner liner 38 of the door 12 of the refrigeration unit 14. The ladder assembly 10 is configured to support a structure 40 that is mounted to the ladder assembly 10. In various implementations, the structure 40 that is configured to be mounted to the ladder assembly 10 is selectively mounted. In other words, the structure 40 may be removed and remounted to the ladder assembly 10, in various implementations. The structure 40 that is configured to be mounted to the ladder assembly 10 may be a shelf 42. For example, in the embodiment illustrated in FIG. 1, a plurality of shelves 42 are coupled to the ladder assembly 10 that is secured to the door 12 of the refrigeration unit 14. It is contemplated that the door 12 and/or the cabinet 34 of the refrigeration unit 14 may include a plurality of ladder assemblies 10 that may be utilized to support the shelf 42.

Figure 2:
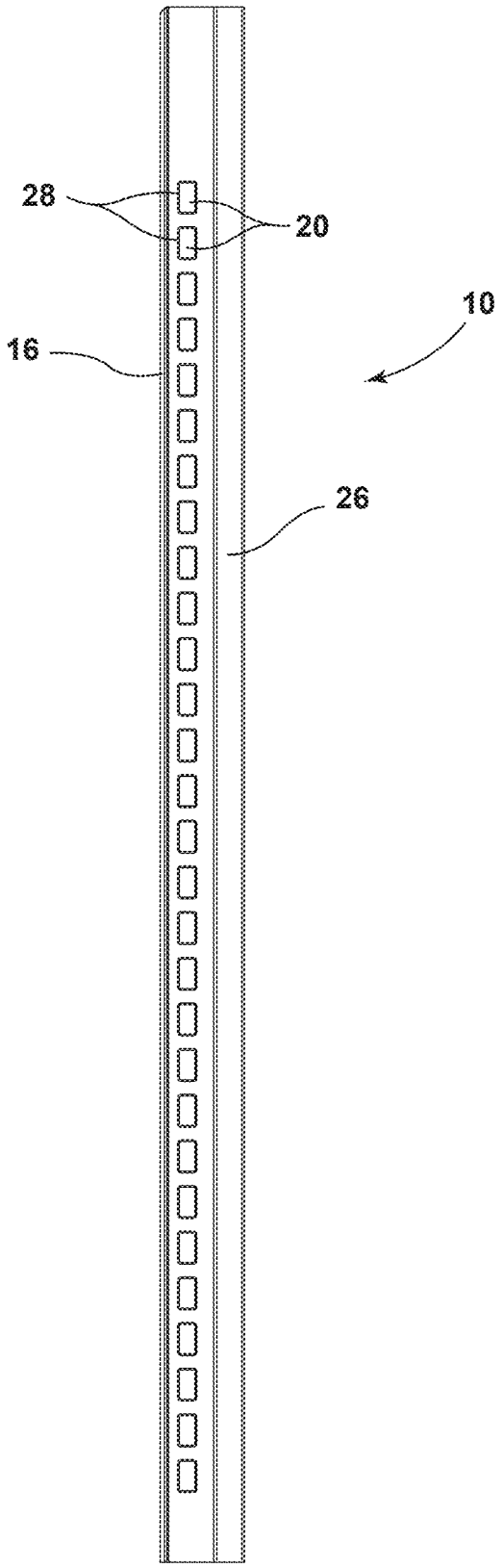
FIG. 2 is an elevational view of a ladder assembly that includes a support ladder and a ladder cover.
Figure 3:
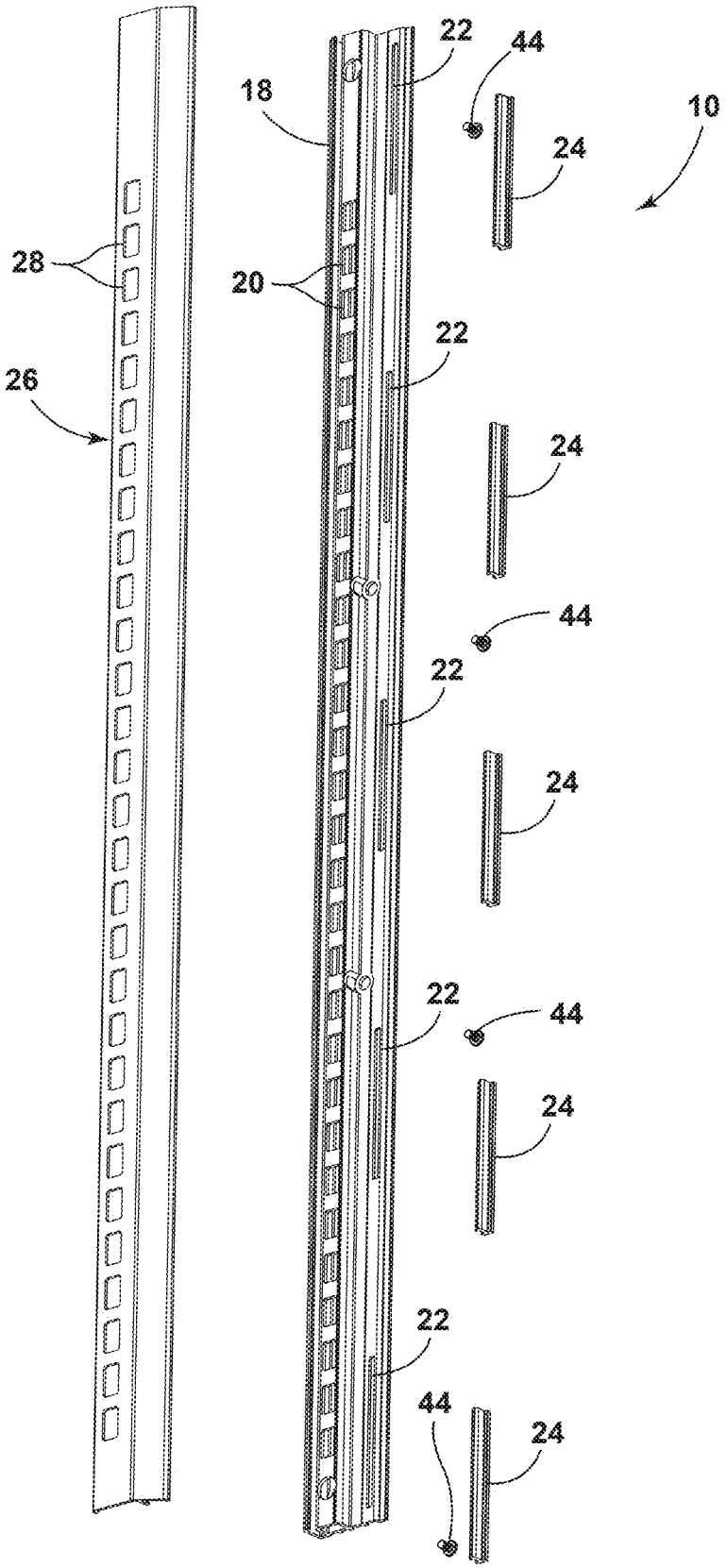
FIG. 3 is an exploded view of the ladder assembly illustrating the support ladder, the ladder cover, a plurality of fasteners, and a plurality of resilient snaps.
Figure 4:
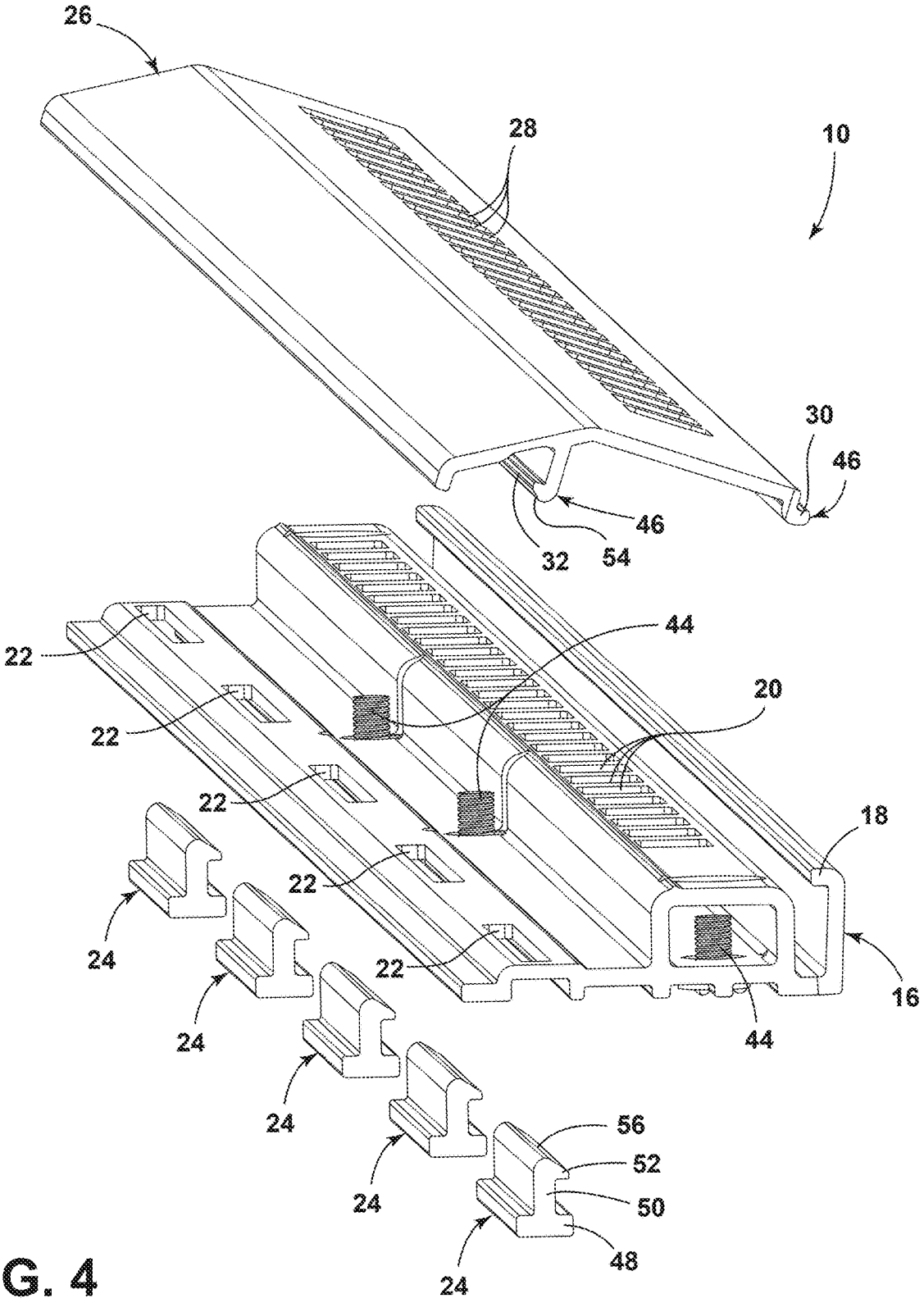
FIG. 4 is a top perspective view of the ladder assembly illustrating the plurality of resilient snaps aligned with a plurality of slots defined by the support ladder, and the ladder cover in a disengaged condition, wherein a first engagement feature of the ladder cover is disengaged from a retention hook of the support ladder and a second engagement feature of the ladder cover is disengaged from the plurality of resilient snaps.

Referring now to FIGS. 2-4, the ladder assembly 10 includes the support ladder 16. The support ladder 16 may be coupled to the inner liner 38 of the refrigeration unit 14. For example, the support ladder 16 may be secured to the inner liner 38 of the door 12 of the refrigeration unit 14 via a plurality of fasteners 44, in some embodiments. In the embodiment illustrated in FIGS. 3 and 4, the ladder assembly 10 includes a plurality of fasteners 44 in the form of bolts that extend through holes defined by the support ladder 16.

Referring still to FIGS. 2-4, the support ladder 16 defines the plurality of mounting apertures 20. As illustrated in FIGS. 3 and 4, the plurality of mounting apertures 20 are distributed along a length of the support ladder 16. The mounting apertures 20 are configured to receive a coupling feature (not shown) of the structure 40 (e.g., shelf 42) that is configured to be mounted to the ladder assembly 10. The support ladder 16 further defines a slot 22. As illustrated in FIGS. 3 and 4, in various implementations, the support ladder 16 defines a plurality of slots 22. The slots 22 are configured to receive resilient snaps 24, as described further herein. As illustrated in FIG. 4, the support ladder 16 includes the retention hook 18. The retention hook 18 is configured for selective engagement with an engagement feature 46 of the ladder cover 26, as described further herein.

Figure 5:
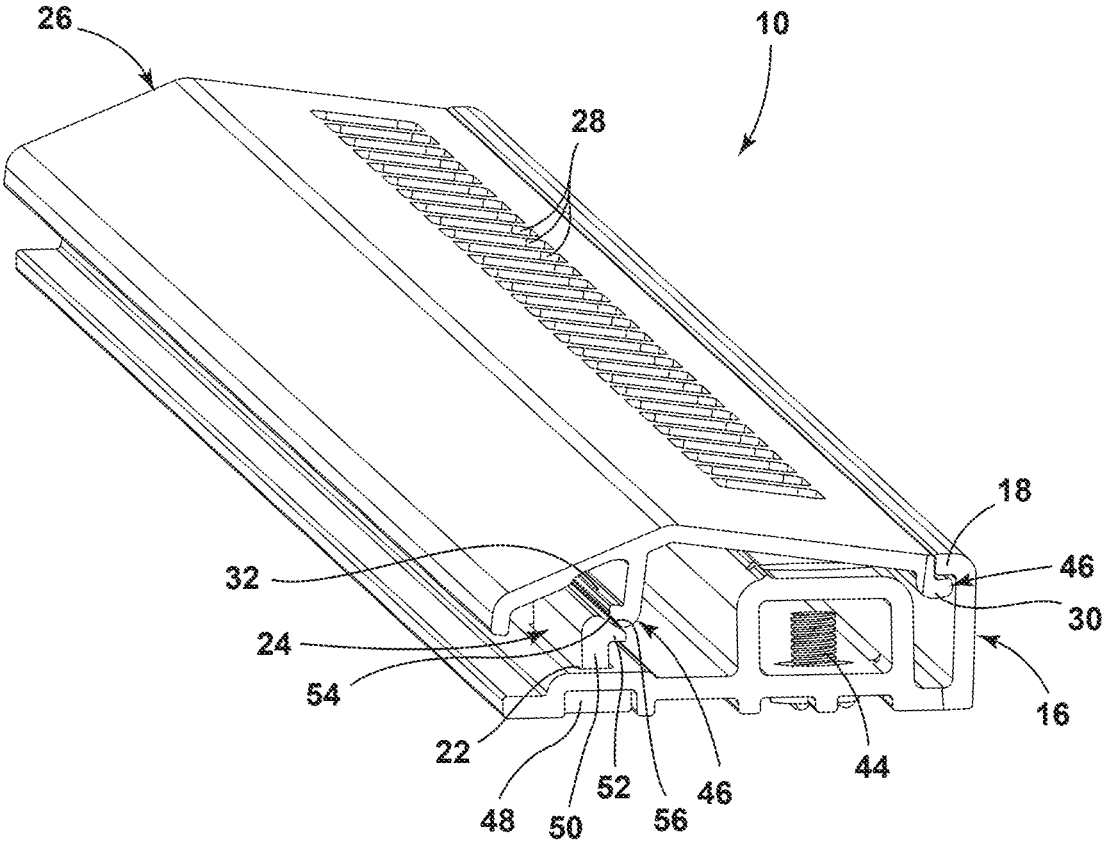
FIG. 5 is a top perspective view of the ladder assembly, illustrating the plurality of resilient snaps received within the plurality of mounting apertures defined by the support ladder and the ladder cover in a disengaged condition, wherein the first engagement feature is pivotably engaged with the retention hook and the second engagement feature is disengaged from the plurality of resilient snaps.

Referring now to FIGS. 3-6, the ladder assembly 10 includes the resilient snap 24. In various embodiments, the ladder assembly 10 includes a plurality of resilient snaps 24. The resilient snap 24 is configured to be received within the slot 22 defined by the support ladder 16, as illustrated in FIG. 5. In some implementations, the resilient snap 24 may resiliently deform to allow for insertion of the resilient snap 24 into the slot 22 defined by the support ladder 16. In some embodiments, the resilient snap 24 is operable to be removed from the slot 22 via, for example, resilient deformation of the resilient snap 24.

In the embodiment illustrated in FIG. 4, the resilient snap 24 includes a base 48, an extended portion 50 that extends from the base 48 through at least one of the plurality of slots 22, and a projection 52 that extends outward from the extended portion 50. The projection 52 is configured for engagement with the engagement feature 46 of the ladder cover 26, in various embodiments, as described further herein.

In the embodiment illustrated in FIG. 5, the support ladder 16 defines the plurality of slots 22, and the ladder assembly 10 includes the plurality of resilient snaps 24. As illustrated, the plurality of resilient snaps 24 are respectively received within the plurality of slots 22 defined by the support ladder 16.

Referring now to FIGS. 2-6, the ladder assembly 10 includes the ladder cover 26. The ladder cover 26 defines a plurality of apertures 28. The plurality of apertures 28 are configured to be respectively aligned with the plurality of mounting apertures 20 defined by the support ladder 16 in the engaged condition of the ladder cover 26, as described further herein. The apertures 28 defined by the ladder cover 26 are configured to receive the coupling feature of the structure 40 (e.g., shelf 42) that is configured to be mounted to the ladder assembly 10. In various implementations, the coupling feature is received within both the aperture 28 defined by the ladder cover 26 and the corresponding mounting aperture 20 defined by the support ladder 16.

Figure 6:
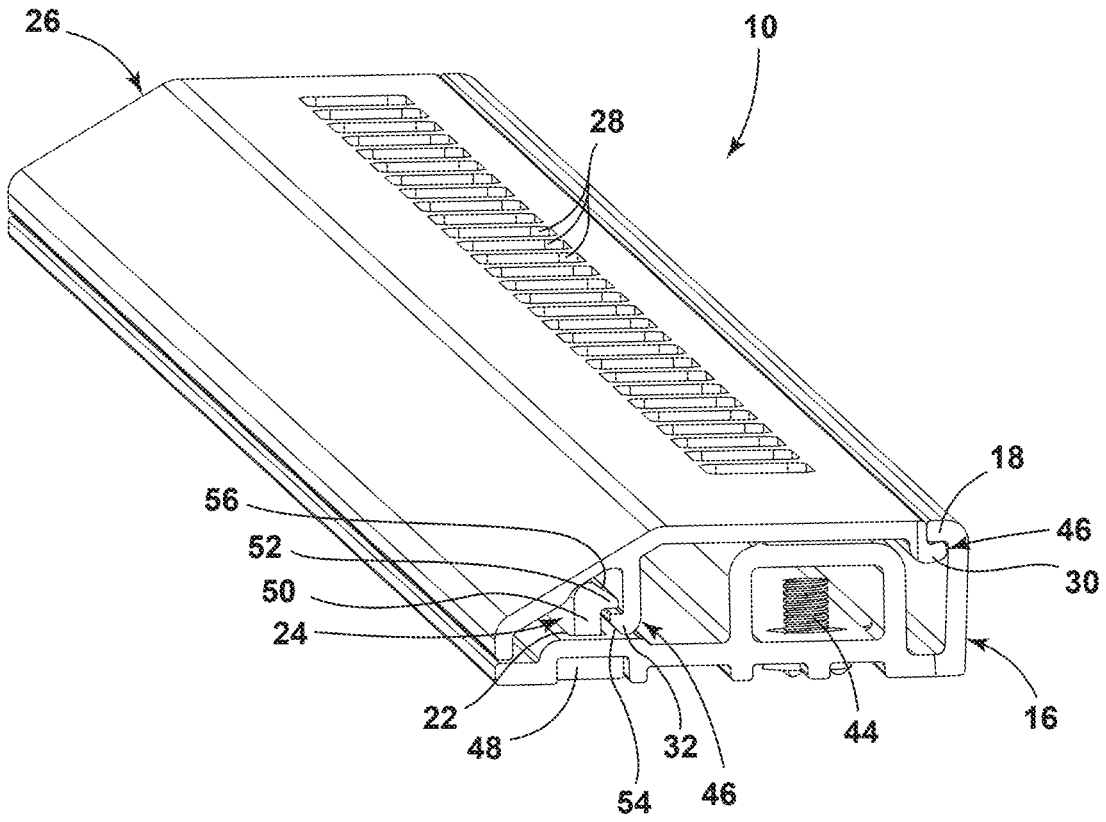
FIG. 6 is a top perspective view of the ladder assembly, illustrating the ladder cover in an engaged condition, wherein the first engagement feature is engaged with the retention hook and the second engagement feature is engaged with the resilient snap received within the slot defined by the support ladder.

Referring now to FIGS. 4-6, the ladder cover 26 includes the engagement feature 46. The engagement feature 46 may be configured to be engaged with the retention hook 18 of the support ladder 16 and/or the resilient snap 24 of the ladder assembly 10. In various embodiments, the ladder cover 26 includes a plurality of engagement features 46. For example, in the embodiment illustrated in FIGS. 4-6, the ladder cover 26 includes the first engagement feature 30 and the second engagement feature 32.

The first engagement feature 30 is configured to be engaged with the retention hook 18 of the support ladder 16. In some implementations, the first engagement feature 30 is pivotably engaged with the retention hook 18. Pivotal movement of the ladder cover 26 relative to the support ladder 16 may be facilitated by the engagement of the first engagement feature 30 and the retention hook 18, in various implementations. The engagement of the first engagement feature 30 and the retention hook 18 may be selective engagement. For example, in the embodiment illustrated in FIG. 4, the first engagement feature 30 is disengaged from the retention hook 18, and in the embodiments illustrated in FIGS. 5 and 6, the first engagement feature 30 is engaged with the retention hook 18 of the support ladder 16.

The second engagement feature 32 of the ladder cover 26 is configured to be engaged with the resilient snap 24 that is received within the slot 22 defined by the support ladder 16. In various implementations, the second engagement feature 32 may be engaged with a plurality of resilient snaps 24. As illustrated in FIG. 6, the second engagement feature 32 is engaged with the projection 52 of the resilient snap 24. Engagement of the second engagement feature 32 and the at least one resilient snap 24 may be selective engagement, in some implementations.

Referring now to FIGS. 4-6, the ladder cover 26 is operable between the disengaged condition and the engaged condition. In the disengaged condition, the second engagement feature 32 is disengaged from the resilient snap 24. The first engagement feature 30 may be disengaged or engaged with the retention hook 18 in the disengaged condition of the ladder cover 26, as illustrated in FIGS. 4 and 5, respectively. In the engaged condition of the ladder cover 26, the first engagement feature 30 is engaged with the retention hook 18 and the second engagement feature 32 is engaged with the at least one resilient snap 24.

In various implementations, the first engagement feature 30 is operable to be pivotably engaged with the retention hook 18 in the disengaged condition of the ladder cover 26 to facilitate pivotal movement of the ladder cover 26 from the disengaged condition, as illustrated in FIG. 5, to the engaged condition, as illustrated in FIG. 6. In some implementations, at least one of the ladder cover 26 and the at least one resilient snap 24 are configured to resiliently deform to allow the ladder cover 26 to enter the engaged condition from the disengaged condition. In some implementations, the at least one resilient snap 24 is configured to resiliently deform to allow the ladder cover 26 to enter the engaged condition due to forcible contact between the ladder cover 26 and the at least one resilient snap 24. For example, in the embodiment illustrated in FIGS. 5 and 6, the second engagement feature 32 of the ladder cover 26 includes a sloped surface 54 that coincides with a corresponding sloped surface 56 of the projection 52 of the resilient snap 24 as the ladder cover 26 is pivoted toward the engaged condition via the pivotal engagement of the first engagement feature 30 and the retention hook 18. As the corresponding sloped surfaces 54, 56 of the second engagement feature 32 and the projection 52 of the resilient snap 24 come into forcible contact, the angle of the sloped surfaces 54, 56 urges the resilient snap 24 to resiliently deform, which allows the ladder cover 26 to enter the engaged condition. In the engaged condition, the second engagement feature 32 and the projection 52 of the resilient snap 24 are engaged to restrict disengagement of the ladder cover 26, as illustrated in FIG. 6. As illustrated in FIG. 2, the plurality of apertures 28 defined by the ladder cover 26 are respectively aligned with the plurality of mounting apertures 20 defined by the support ladder 16.

The support ladder 16 of the present disclosure may provide a variety of advantages. First, the ladder cover 26 may provide an aesthetically pleasing appearance to the portion of the ladder assembly 10 that is readily visible to a user of the refrigeration unit 14. Second, pivotal engagement between the first engagement feature 30 and the retention hook 18 ensures intuitive, convenient assembly of the ladder cover 26 to the support ladder 16. Third, the use of the plurality of resilient snaps 24 allows for a snap fit solution for assembling the ladder cover 26 of the ladder assembly 10 to the support ladder 16 without requiring the support ladder 16 to be formed of the resiliently deformable material.

According to one aspect of the present disclosure, a ladder assembly for a door of a refrigeration unit includes a support ladder that includes a retention hook and defines a plurality of mounting apertures distributed along a length of the support ladder and a plurality of slots. The support ladder is mounted to said door of said refrigeration unit. The ladder assembly for the door of the refrigeration unit also includes a plurality of resilient snaps respectively received within the plurality of slots defined by the support ladder. The ladder assembly for the door of the refrigeration unit further includes a ladder cover that defines a plurality of apertures. The ladder cover has a first engagement feature and a second engagement feature and is operable between a disengaged condition and an engaged condition. In the disengaged condition, the second engagement feature is disengaged from the plurality of resilient snaps. In the engaged condition, the first engagement feature is engaged with the retention hook, the second engagement feature is engaged with the plurality of resilient snaps, and the plurality of apertures are respectively aligned with the plurality of mounting apertures.

According to another aspect, at least one of the plurality of resilient snaps includes a base, an extended portion that extends from the base through at least one of the plurality of slots, and a projection that extends outward from the extended portion. The second engagement feature is engaged with the projection in the engaged condition of the ladder cover.

According to another aspect, at least one of the ladder cover and the at least one resilient snap are configured to resiliently deform to allow the ladder cover to enter the engaged condition from the disengaged condition.

According to another aspect, the at least one resilient snap is configured to resiliently deform to allow the ladder cover to enter the engaged condition due to forcible contact between the ladder cover and the at least one resilient snap.

According to another aspect, the first engagement feature is operable to be pivotably engaged with the retention hook in the disengaged condition of the ladder cover to facilitate pivotal movement of the ladder cover from the disengaged condition to the engaged condition.

According to another aspect, the support ladder is secured to an inner liner of said door via a plurality of fasteners.

According to another aspect of the present disclosure, a ladder assembly for a refrigeration unit includes a support ladder that includes a retention hook and defines a plurality of mounting apertures distributed along a length of the support ladder and a slot, a resilient snap received within the slot, and a ladder cover that includes a first engagement feature that is engaged with the retention hook and a second engagement feature that is engaged with the resilient snap to engage the ladder cover with the support ladder.

According to another aspect, the ladder assembly is configured to be mounted to a door of said refrigeration unit.

According to another aspect, the ladder cover defines a plurality of apertures, and the plurality of apertures are respectively aligned with the plurality of mounting apertures defined by the support ladder.

According to another aspect, the ladder cover is operable between an engaged condition and a disengaged condition. In the engaged condition of the ladder cover, the first engagement feature is engaged with the retention hook and the second engagement feature is engaged with the resilient snap. In the disengaged condition of the ladder cover, the second engagement feature is disengaged from the resilient snap.

According to another aspect, the first engagement feature is operable to be pivotably engaged with the retention hook in the disengaged condition of the ladder cover to facilitate pivotal movement of the ladder cover from the disengaged condition to the engaged condition.

According to another aspect, the resilient snap includes a base, an extended portion that extends from the base through the slot, and a projection that extends outward from the extended portion. The second engagement feature is engaged with the projection in the engaged condition of the ladder cover.

According to another aspect, the resilient snap is configured to resiliently deform to allow the ladder cover to enter the engaged condition from the disengaged condition.

According to another aspect, the resilient snap is configured to resiliently deform to allow the ladder cover to enter the engaged condition due to forcible contact between the second engagement feature of the ladder cover and the projection of the resilient snap.

According to another aspect, the support ladder is secured to an inner liner of said door via a plurality of fasteners.

According to yet another aspect of the present disclosure, a ladder assembly for mounting a structure thereon includes a support ladder that defines a plurality of mounting apertures distributed along a length of the support ladder and a slot, a resilient snap received within the slot, and a ladder cover that includes an engagement feature that is engaged with the resilient snap in an engaged condition of the ladder cover to engage the ladder cover with the support ladder.

According to another aspect, the support ladder includes a retention hook and the ladder cover includes a plurality of engagement features including a first engagement feature that is engaged with the retention hook, and a second engagement feature that is the engagement feature that is engaged with the resilient snap.

According to another aspect, the ladder cover is operable between an engaged condition and a disengaged condition. In the engaged condition of the ladder cover, the first engagement feature is engaged with the retention hook and the second engagement feature is engaged with the resilient snap. In the disengaged condition of the ladder cover, the second engagement feature is disengaged from the resilient snap.

According to another aspect, the first engagement feature is operable to be pivotably engaged with the retention hook in the disengaged condition of the ladder cover to facilitate pivotal movement of the ladder cover from the disengaged condition to the engaged condition.

According to another aspect, said structure is a shelf of a refrigeration unit.

It will be understood by one having ordinary skill in the art that construction of the described disclosure and other components is not limited to any specific material. Other exemplary embodiments of the disclosure disclosed herein may be formed from a wide variety of materials, unless described otherwise herein.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A ladder assembly for a door of a refrigeration unit, comprising:

a support ladder that includes a retention hook and defines a plurality of mounting apertures distributed along a length of the support ladder and a plurality of slots, wherein the support ladder is mounted to said door of said refrigeration unit;

a plurality of resilient snaps respectively received within the plurality of slots defined by the support ladder; and a ladder cover that defines a plurality of apertures, the ladder cover having a first engagement feature and a second engagement feature and being operable between a disengaged condition, wherein the second engagement feature is disengaged from the plurality of resilient snaps, and an engaged condition, wherein the first engagement feature is engaged with the retention hook, the second engagement feature is engaged with the plurality of resilient snaps, and the plurality of apertures are respectively aligned with the plurality of mounting apertures.

2. The ladder assembly of claim 1, wherein at least one of the plurality of resilient snaps comprises:

a base;

an extended portion that extends from the base through at least one of the plurality of slots; and a projection that extends outward from the extended portion, wherein the second engagement feature is engaged with the projection in the engaged condition of the ladder cover.

3. The ladder assembly of claim 2, wherein at least one of the ladder cover and the at least one resilient snap are configured to resiliently deform to allow the ladder cover to enter the engaged condition from the disengaged condition.

4. The ladder assembly of claim 3, wherein the at least one resilient snap is configured to resiliently deform to allow the ladder cover to enter the engaged condition due to forcible contact between the ladder cover and the at least one resilient snap.

5. The ladder assembly of claim 1, wherein the first engagement feature is operable to be pivotably engaged with the retention hook in the disengaged condition of the ladder cover to facilitate pivotal movement of the ladder cover from the disengaged condition to the engaged condition.

6. The ladder assembly of claim 1, wherein the support ladder is secured to an inner liner of said door via a plurality of fasteners.

7. A ladder assembly for a refrigeration unit, comprising:

a support ladder that includes a retention hook and defines a plurality of mounting apertures distributed along a length of the support ladder and a slot;

a resilient snap received within the slot; and a ladder cover that includes a first engagement feature that is engaged with the retention hook and a second engagement feature that is engaged with the resilient snap to engage the ladder cover with the support ladder.

8. The ladder assembly of claim 7, wherein the ladder assembly is configured to be mounted to a door of said refrigeration unit.

9. The ladder assembly of claim 8, wherein the support ladder is secured to an inner liner of said door via a plurality of fasteners.

10. The ladder assembly of claim 7, wherein the ladder cover defines a plurality of apertures, and the plurality of apertures are respectively aligned with the plurality of mounting apertures defined by the support ladder.

11. The ladder assembly of claim 7, wherein the ladder cover is operable between an engaged condition, wherein the first engagement feature is engaged with the retention hook and the second engagement feature is engaged with the resilient snap, and a disengaged condition, wherein the second engagement feature is disengaged from the resilient snap.

12. The ladder assembly of claim 11, wherein the first engagement feature is operable to be pivotably engaged with the retention hook in the disengaged condition of the ladder cover to facilitate pivotal movement of the ladder cover from the disengaged condition to the engaged condition.

13. The ladder assembly of claim 12, wherein the resilient snap comprises:

a base;

an extended portion that extends from the base through the slot; and a projection that extends outward from the extended portion, wherein the second engagement feature is engaged with the projection in the engaged condition of the ladder cover.

14. The ladder assembly of claim 13, wherein the resilient snap is configured to resiliently deform to allow the ladder cover to enter the engaged condition from the disengaged condition.

15. The ladder assembly of claim 14, wherein the resilient snap is configured to resiliently deform to allow the ladder cover to enter the engaged condition due to forcible contact between the second engagement feature of the ladder cover and the projection of the resilient snap.

16. A ladder assembly for mounting a structure thereon, comprising:

a support ladder that defines a plurality of mounting apertures distributed along a length of the support ladder and a slot, the support ladder including a retention hook;

a resilient snap received within the slot; and a ladder cover that includes a plurality of engagement features comprising:

a first engagement feature that is engaged with the retention hook; and a second engagement feature that is engaged with the resilient snap in an engaged condition of the ladder cover to engage the ladder cover with the support ladder.

17. The ladder assembly of claim 16, wherein the ladder cover is operable between an engaged condition, wherein the first engagement feature is engaged with the retention hook and the second engagement feature is engaged with the resilient snap, and a disengaged condition, wherein the second engagement feature is disengaged from the resilient snap.

18. The ladder assembly of claim 17, wherein the first engagement feature is operable to be pivotably engaged with the retention hook in the disengaged condition of the ladder cover to facilitate pivotal movement of the ladder cover from the disengaged condition to the engaged condition.

19. The ladder assembly of claim 16, wherein said structure is a shelf of a refrigeration unit.

* * * * *